US008863316B2

(12) United States Patent
Gaskins

(10) Patent No.: US 8,863,316 B2
(45) Date of Patent: Oct. 21, 2014

(54) HORSEBACK RIDING TRAINING GLOVE

(75) Inventor: Jessica Gaskins, Charleston, SC (US)

(73) Assignee: Jessica Gaskins, Charleston, SC (US)

( * ) Notice: Subject to any disclaimer, the term of this patent is extended or adjusted under 35 U.S.C. 154(b) by 623 days.

(21) Appl. No.: 12/823,193

(22) Filed: Jun. 25, 2010

(65) Prior Publication Data

US 2011/0314588 A1 Dec. 29, 2011

(51) Int. Cl.

| | |
|---|---|
| ***A41D 19/00*** | (2006.01) |
| ***A63B 71/14*** | (2006.01) |
| ***A41D 19/015*** | (2006.01) |
| *A63B 21/00* | (2006.01) |

(52) U.S. Cl.

CPC ..... *A41D 19/01547* (2013.01); *A63B 71/141* (2013.01); *A63B 2209/10* (2013.01); *A63B 71/146* (2013.01); *A63B 2209/08* (2013.01); *A63B 21/1434* (2013.01); *A63B 2244/24* (2013.01)

USPC ..... 2/161.1

(58) Field of Classification Search

USPC ..... 2/159, 16, 161.1, 161.5, 161.6, 20, 163, 2/161.2; 54/36, 6.1, 73, 74, 1; 473/205, 473/206; 294/25; 24/303

See application file for complete search history.

(56) References Cited

U.S. PATENT DOCUMENTS

| | | | | |
|---|---|---|---|---|
| 558,604 | A * | 4/1896 | Engel | 2/164 |
| 3,144,274 | A * | 8/1964 | Harris | 297/481 |
| 4,665,565 | A * | 5/1987 | Odom | 2/161.2 |
| 4,691,387 | A | 9/1987 | Lopez | |
| 5,435,013 | A | 7/1995 | Davis | |
| 5,462,280 | A | 10/1995 | Dickerson | |
| 5,542,126 | A | 8/1996 | Harvanek | |
| 5,715,539 | A | 2/1998 | Benecki et al. | |
| 5,946,721 | A | 9/1999 | Dance | |
| 6,591,590 | B1 | 7/2003 | Henneberg | |
| 6,643,845 | B2 * | 11/2003 | O'Dea et al. | 2/161.6 |
| 7,207,894 | B2 * | 4/2007 | Pine | 473/201 |
| 7,228,678 | B2 | 6/2007 | Wilson | |
| 7,661,150 | B2 * | 2/2010 | Hess | 2/160 |
| 8,205,269 | B2 * | 6/2012 | Anderson | 2/161.2 |
| 2004/0110116 | A1 | 6/2004 | Pretty et al. | |
| 2010/0269239 | A1 * | 10/2010 | Kulp et al. | 2/69 |

* cited by examiner

*Primary Examiner* — Khoa Huynh

*Assistant Examiner* — Anna Kinsaul

(74) *Attorney, Agent, or Firm* — Abel Law Group, LLP; Matthew W. Hammersley

(57) ABSTRACT

An improved horseback riding training glove that includes engagement mechanisms positioned on a plurality of fingertip sections, a palm section, a thumbtip section and a side of the index finger section. When the engagement mechanisms positioned on the fingertip sections releasably connect with the engagement mechanisms positioned on the palm section and the engagement mechanism positioned on the thumbtip section releasably connects with the engagement mechanism positioned on the side index finger section, a rider's fingers may be secured in the proper position for gripping the reins, while also allowing the rider to disconnect the engagement mechanisms by spreading out their fingers.

23 Claims, 15 Drawing Sheets

HORSEBACK RIDING TRAINING GLOVE

FIELD OF THE INVENTION

The present invention generally relates to horseback riding training gloves, and more particularly to horseback riding training gloves that allow the rider's fingers to hold the reins correctly in the proper position.

BACKGROUND OF THE INVENTION

Horseback riding is a popular recreational activity and sport. One of the most difficult aspects of horseback riding is maintaining the proper position of the fingers when gripping the reins. Correct position of the fingers about the reins is important to maintain effective control and communication over a horse. Having the proper finger position about the reins will also aid the rider in also keeping their hands in the correct position.

Furthermore, in training for the sport of competitive horseback riding, a rider trains for many hours to learn to guide a horse through a series of complex maneuvers by slight movements of the rider's body and hands. Judges of competitive horseback riding award points to the rider for the precise movements of the body and hands. To develop the proper riding techniques and achieve higher scores in competition, the rider must learn the proper position of the fingers about the reins.

In almost every instance of recreational and competitive horseback riding, the rider wears gloves to protect their hands when gripping the reins. The conventional horseback riding glove has a thick outer layer for protection and wear resistance, and a softer inner layer that provides a better feel against the rider's hands.

One drawback of traditional horseback riding gloves is the difficulty for the rider to feel that their fingers are in the proper position when riding, especially for new or inexperienced riders. For example, new or inexperienced riders tend to open or rotate their fingers about the reins. When the fingers are open and loose, the rider will have poor control of the horse. Furthermore, when the fingers are out of position, the rider's hands and wrists will invariable not be in the proper position.

Attempts have been made to teach the correct position of the rider's fingers about the reins, but have drawbacks. For example, a horseback riding training glove is described in U.S. Pat. No. 5,946,721 and includes a glove having visual indicators on the glove to quickly relay information to an instructor about whether the rider's hands are in the proper position. However, the training glove does not include any means for a physical attachment of the glove to itself.

Another horseback riding training system is described in U.S. Pat. No. 6,591,590 and includes a training rein system in which a pair of gloves is worn by the rider with each glove having a mechanical fastener so that when the rider grasps the reins while wearing the gloves, the gloves and thus the rider's hands, are mechanically fastened to the reins. This invention only teaches how to keep the rider's hand secured to the reins. The invention does not teach how the correct finger position about reins.

Another type of horseback riding glove includes a traditional horseback riding glove, where the entire front surface is covered with a tacky substance to achieve a better contact with the reins. However, the tacky horseback riding glove does not teach a rider the correct position of the fingers about the reins, or provide any indication that the rider's finger position is correct.

Conventional horseback riding training gloves are thus ill-suited for physically keeping the rider's fingers in the proper position about the reins while allowing the rider to easily disengage for safety.

SUMMARY OF THE INVENTION

In certain embodiments of the present invention, a glove for training a horseback rider may generally include an inner layer and an outer layer. In other embodiments, the glove may include only a single layer. The glove may further include a plurality of fingertip sections having at least one engagement mechanism positioned on each fingertip section; a thumbtip section, having at least one engagement mechanism positioned on the thumbtip section; a side index finger section, having at least one engagement mechanism positioned on the side index finger section; and a palm section, having at least one engagement mechanism positioned on the palm section. The engagement mechanisms positioned on the plurality of fingertip sections releasably connect with the second plurality of engagement mechanisms positioned on the palm section and wherein the engagement mechanism positioned on thumbtip section releasably connects with the engagement mechanism positioned on the side index finger section.

In certain embodiments, the engagement mechanisms may be positioned on the outer surface of the outer layer. Alternatively, the engagement mechanisms may be positioned between the inner layer and the outer layer.

The release force of the engagement mechanisms should be selected so that the engagement mechanisms stay connected when the rider is riding, but allow the rider to disconnect the engagement mechanisms by the rider spreading out their fingers.

In certain embodiments, the glove may have at least a portion of the outer layer removed so that the engagement mechanisms positioned on each fingertip section can directly connect with the engagement mechanisms positioned on the palm section and the engagement mechanisms positioned on the thumbtip section can directly connect with the engagement mechanism positioned on the side index finger section.

In other embodiments, the glove may further include a cover layer positioned over the engagement mechanisms. The cover layer may then be attached to the outer layer of the glove. In certain embodiments, at least a portion of the cover layer may be removed so that the engagement mechanisms positioned on each fingertip section can directly connect with the engagement mechanisms positioned on the palm section and the engagement mechanisms positioned on the thumbtip section can directly connect with the engagement mechanism positioned on the side index finger section.

In still further embodiments, the engagement mechanisms may be encased within a pocket, and the pocket may then be attached to the glove. In certain embodiments, at least a portion of the pocket may be removed so that the engagement mechanisms positioned on each fingertip section can directly connect with the engagement mechanisms positioned on the palm section and the engagement mechanisms positioned on the thumbtip section can directly connect with the engagement mechanism positioned on the side index finger section.

In certain embodiments, the plurality of fingertip sections, the thumbtip section, the side index finger section, and the palm section may be debossed to form an indentation in the inner layer, outer layer, or both. The engagement mechanisms may then be attached to the inner layer, outer layer, or both within the indentations.

The glove may further include a padding layer positioned between the engagement mechanisms and a rider's finger.

The glove may further include engagement mechanisms that are a different color than the outer layer of the glove.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts, and in which.

DETAILED DESCRIPTION OF THE FIGURES

Figure 1A:
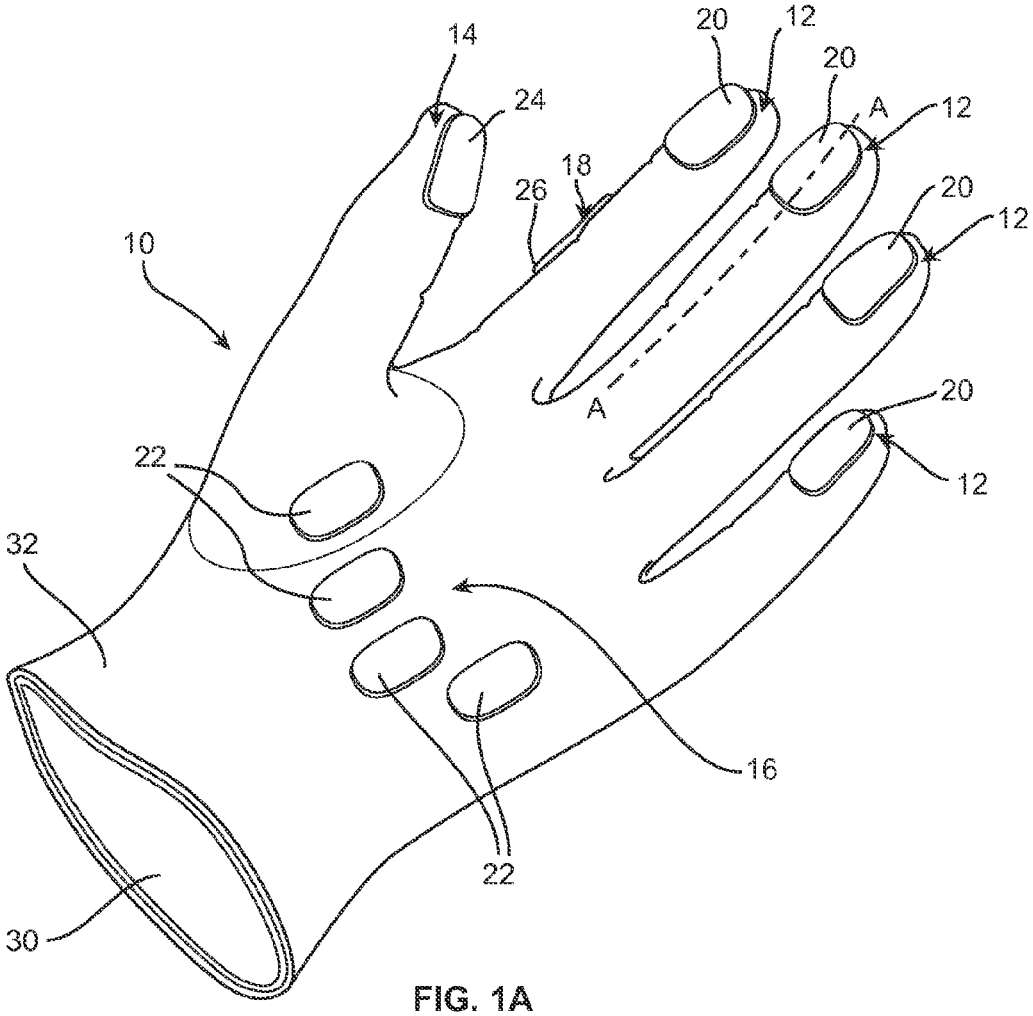
FIG. 1A illustrates a perspective view of a horseback riding training glove in the open position according to an embodiment of the present invention.
Figure 1B:
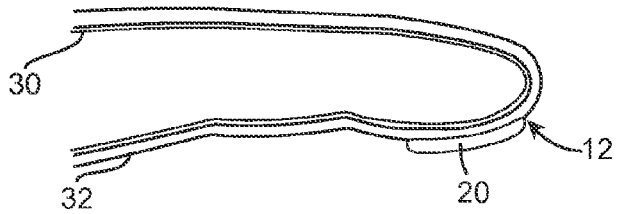
FIG. 1B illustrates a cross section view of a finger along the line A-A in the glove of FIG. 1A.
Figure 1D:
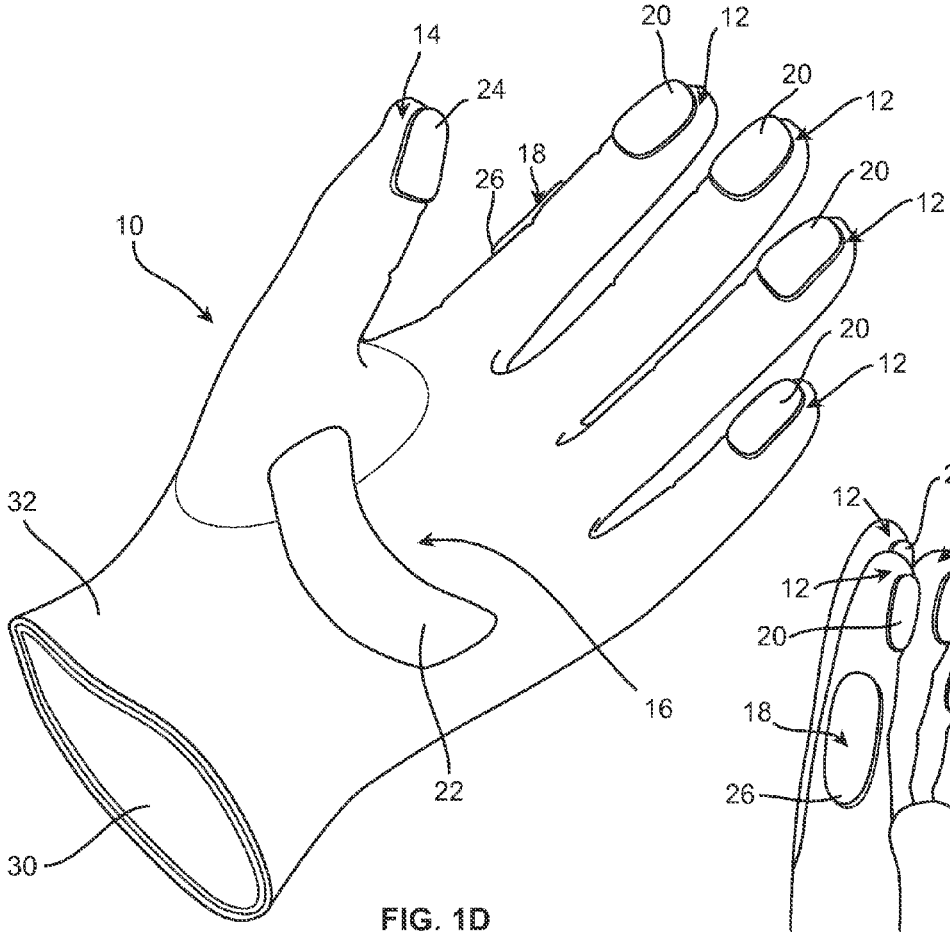
FIG. 1D illustrates a perspective view of a horseback riding training glove in the open position according to an embodiment of the present invention.
Figure 1C:
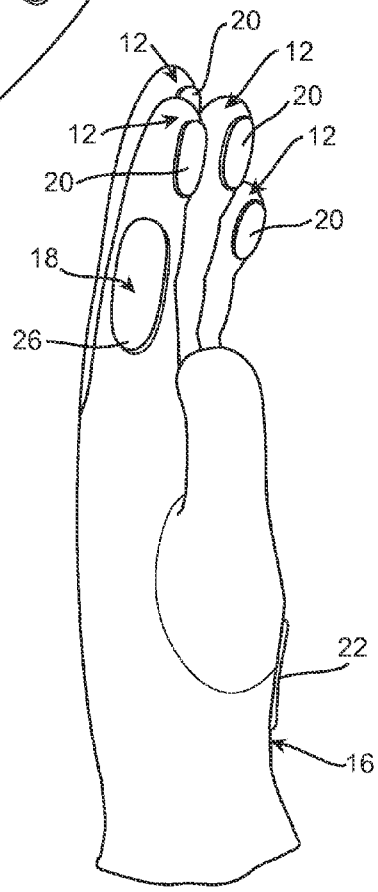
FIG. 1C illustrates a side perspective view of a horseback riding training glove in the open position according to an embodiment of the present invention.
Figures 2A, 2B, 2C, 2D:
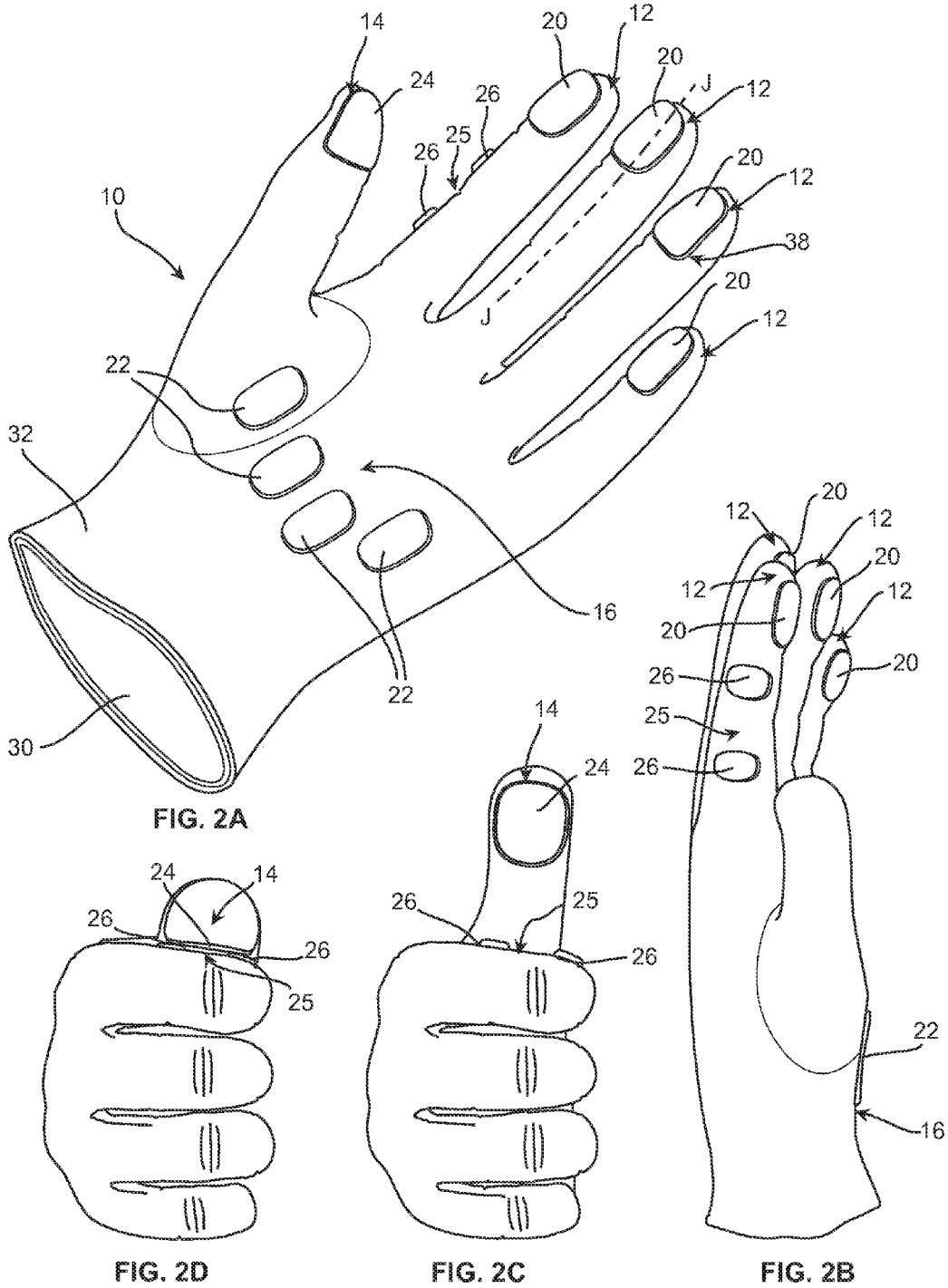
FIG. 2A illustrates a perspective view of a horseback riding training glove in the open position according to another embodiment of the present invention.
FIG. 2B illustrates a cross section view of a finger along the line B-B in the glove of FIG. 2A.
Figures 3A, 3B, 3C, 3D:
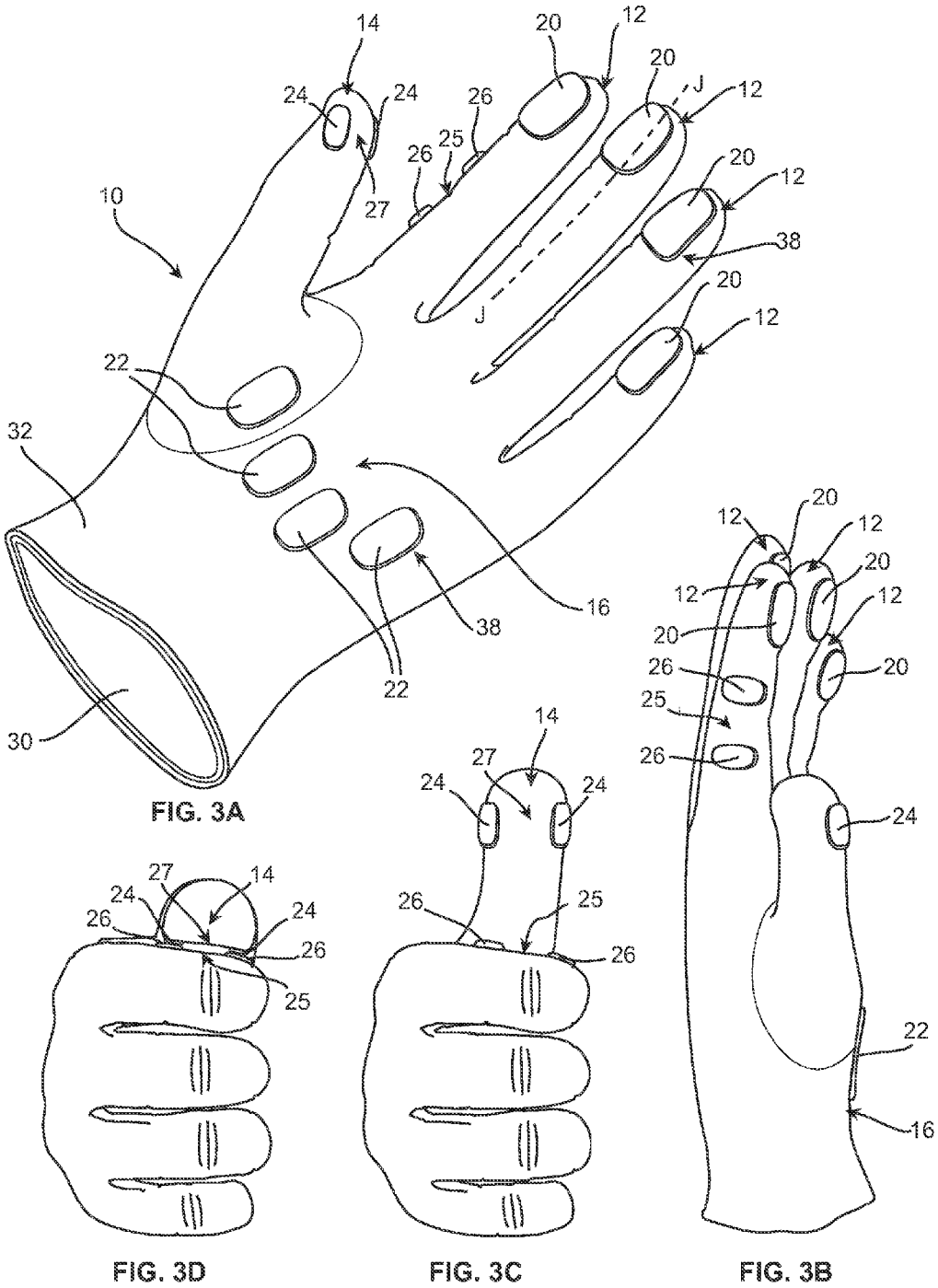
FIG. 3A illustrates a perspective view of a horseback riding training glove in the open position according to another embodiment of the present invention.
FIG. 3B illustrates a cross section view of a finger along the line C-C in the glove of FIG. 3A.

Referring now to FIGS. 1A-1D there is shown a horseback riding glove 10 according to certain embodiments of the present invention. The horseback riding glove 10 may include a fingertip section 12 on each finger, a thumbtip section 14, a palm section 16, and a side index finger section 18. Positioned on each fingertip section 12, thumbtip section 14, palm section 16, and side index finger section 18 is at least one engagement mechanism 20, 22, 24, 26. The engagement mechanisms 20 positioned on the plurality of fingertip sections 12 releasably connect with the engagement mechanisms 22 positioned on the palm section 16. In a similar fashion, the engagement mechanism 24 positioned on the thumbtip section 14 releasably connects with the engagement mechanism 26 positioned on the side index finger section 18. When all of the engagement mechanisms 20, 22, 24, 26 are connected, the glove and thus the rider's fingers may be secured in the proper position for gripping the reins.

The palm section 16 may include a plurality of engagement mechanisms 22. For example, as illustrated in FIG. 1A, the palm section 16 may include an engagement mechanism 22 for each fingertip section 12. Alternatively, as more particularly shown in FIG. 1D, the palm section 16 may include a single engagement mechanism 22 that extends substantially across the palm section 16 of the glove 10. It is to be understood that either configuration of the engagement mechanisms 22 on the palm section may be employed with any embodiment disclosed herein.

When gripping the reins, the reins are preferably positioned between the engagement mechanism 24 positioned on the thumbtip section 14 and the engagement mechanism 26 positioned on the side forefinger section 18. As such, the engagement mechanism 26 positioned on the side index finger section 18 may be larger than the thumbtip section 14 so that the reins may be releasably secured between the thumbtip section 14 and the side index finger section 18 while also pinching the reins.

In certain other embodiments, as more particularly illustrated in FIGS. 2A-2D, the side index finger section 18 may include two engagement mechanisms 26 spaced apart from each other thereby defining a first grove 25. The reins may fit within the first grove 25. Preferably, the first grove 25 has substantially similar dimensions as the reins. For example, the first grove 25 may have a width, between engagement mechanisms 26, from about 0.25 inches to about 1.5 inches. The thumbtip section 14 may include a single engagement mechanism that extends across substantially the entire thumbtip to releasably connect with both engagement mechanisms 26 positioned on the side index finger section 18.

Alternatively, the thumbtip section 14 may be configured substantially similar to the side index finger section 18 described above. For example, as illustrated in FIGS. 3A-3D, the thumbtip section 14 may also include two engagement mechanisms 24 spaced apart from each other, thereby defining a second grove 27. The reins may fit within the first grove 25 and the second grove 27. In other embodiments, the thumbtip section 14 may only contain one engagement mechanism 24 that can be releasably connected to both engagement mechanisms 26 positioned on the side index finger section 18.

In still further embodiments, the thumbtip section 14 may include two engagement mechanisms 24 positioned on the side of the thumbtip section 14. In this arrangement, the rider may be able to put greater direct pressure on the reins with their thumb, but still have their thumb releasably connected to the side index finger section 18 in the proper position.

It is to be understood that the arrangement of engagement mechanisms on the thumbtip section and the side index finger section described in FIGS. 2A-3D may be used with any embodiment disclosed herein.

The glove 10 may be constructed in any configuration known to one of skill in the art. For example, the glove 10 may be constructed with an inner layer 30 and an outer layer 32. The outer layer has an inner surface connected to the inner layer and an outer surface that contacts the reins. The outer layer 32 may be thick to allow for wear and cushioning of the rider's hands against the reins. The inner layer 32 may be softer and provide a better feel against the rider's hands. Alternatively, as discussed in greater detail below, the glove 10 may be constructed with a single layer.

The glove 10 may be constructed by any material known to one of skill in the art. For example, the inner layer 30 and the outer layer 32 may be constructed from a nonwoven fabric, a woven fabric, leather, suede, microfiber or any combination thereof. It is to be understood that the present invention is not limited to a particular material used for the inner layer 30 or the outer layer 32 of the glove 10.

The engagement mechanisms 20, 22, 24, 26 may be any mechanism that allows the glove 10 to releasably connect to itself and hold a rider's fingers securely in the proper position. The rider should be able to disconnect the engagement mechanisms 20, 22, 24, 26 by spreading apart their fingers. For example, the engagement mechanisms 20, 22, 24, 26 may be magnets, hook and loop attachments (e.g. Velcro® type attachment means) snaps, adhesive strips, or any combination thereof. Regardless of the specific type engagement mechanism used, the engagement mechanisms 20, 22, 24, 26 should have a sufficient release force that will allow the engagement mechanisms 20, 22, 24, 26 to stay connected while the rider is performing maneuvers, but also allow the rider to disconnect the engagement mechanisms 20, 22, 24, 26 by spreading out their fingers. This way, the rider can safely keep their fingers attached to the glove 10 at the proper position, but still easily disconnect the engagement mechanisms 20, 22, 24, 26 if the rider begins to fall off the horse or needs to use their hands for stability.

The specific release force properties of the engagement mechanisms 20, 22, 24, 26 may be customized to the strength of the rider. For example, a glove configured for an adult may require a stronger release force than a glove configured for a child. Each different engagement mechanism 20, 22, 24, 26 may have the same release force, or may have a different release force.

When the engagement mechanisms are magnets, all of the engagement mechanisms may be magnets. Alternatively, one of the engagement mechanisms may be a magnet, while the opposing engagement mechanism may be any material capable of being attracted to a magnet, for example iron.

The engagement mechanisms 20, 22, 24, 26 may be secured to the glove 10 in any arrangement known to one of skill in the art. For example, as shown in FIGS. 1A-1D, the engagement mechanisms 20, 22, 24, 26 may be secured directly to the outer layer 32 of the glove 10. The engagement mechanisms 20, 22, 24, 26 may be attached to the outer layer 32 of the glove 10 by any means known to one of skill in the art. For example, the engagement mechanisms 20, 22, 24, 26 may be attached to the outer layer 32 of the glove 10 by an adhesive.

Figure 4A:
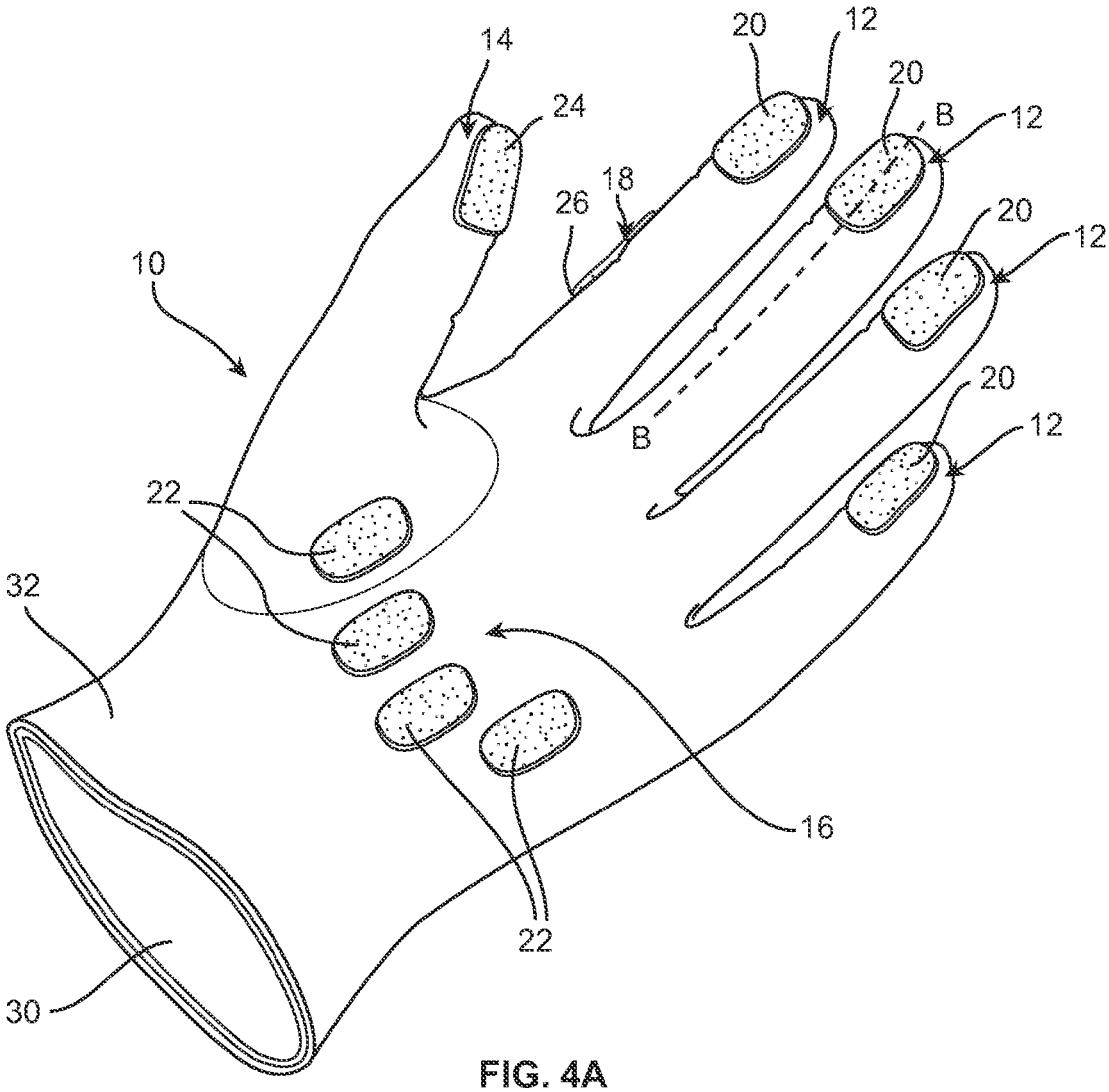
FIG. 4A illustrates a perspective view of a horseback riding training glove in the open position according to another embodiment of the present invention.
Figure 4B:
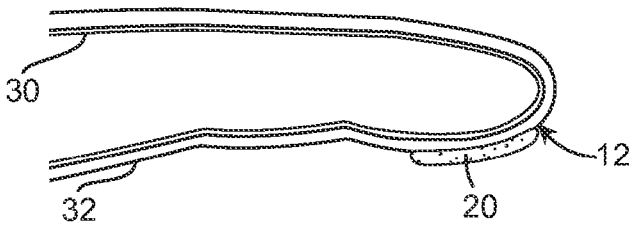
FIG. 4B illustrates a cross section view of a finger along the line D-D in the glove of FIG. 4A.

In another embodiment, as more particularly illustrated in FIGS. 4A-4B, the engagement mechanisms 20, 22, 24, 26 may also be a hook and loop attachment (e.g. Velcro®). In this arrangement, the fingertip section 12 may contain the hook side, while the palm section 16 may contain the loop side. Alternatively, the fingertip section 12 may contain the loop side, while the palm section 16 may contain the hook side.

Figure 5A:
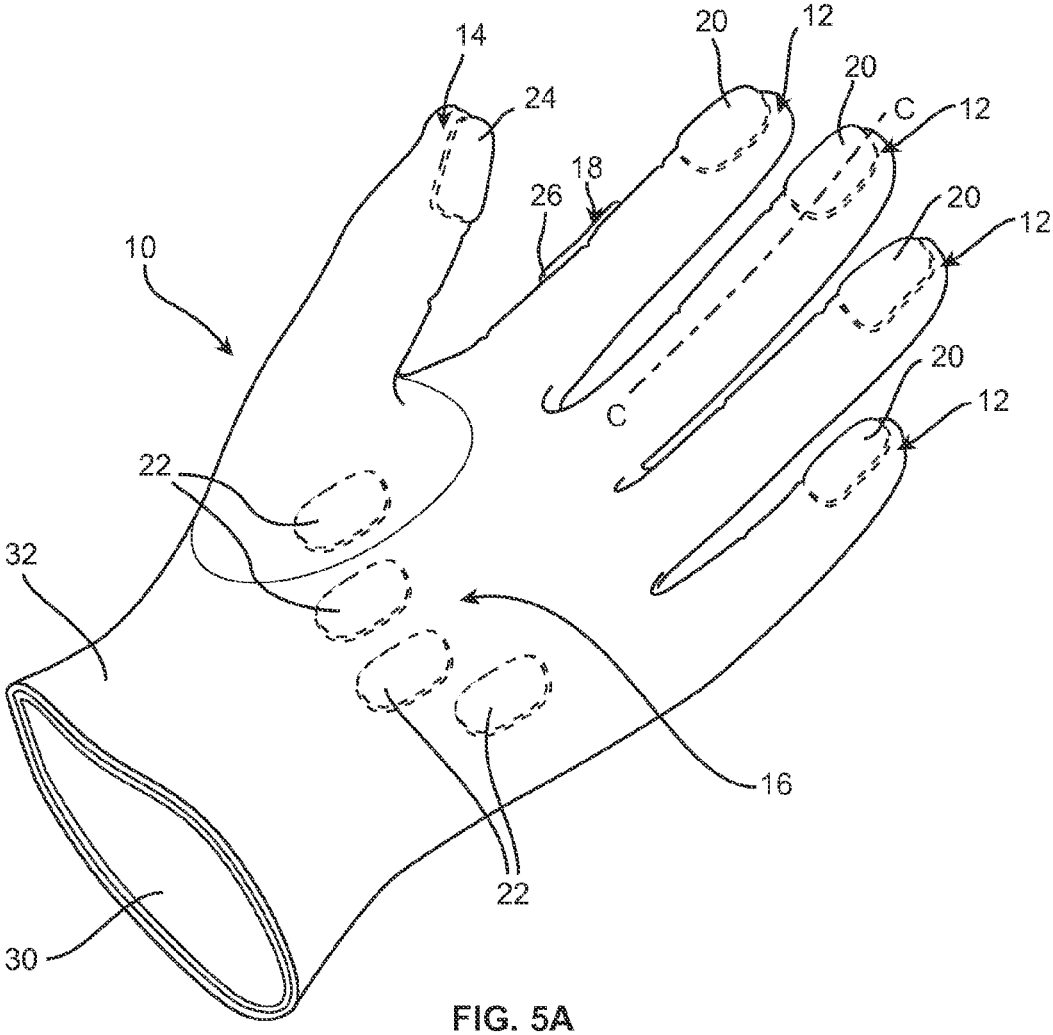
FIG. 5A illustrates a perspective view of a horseback riding training glove in the open position according to another embodiment of the present invention.
Figure 5B:
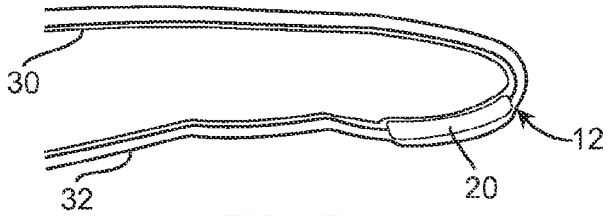
FIG. 5B illustrates a cross section view of a finger along the line E-E in the glove of FIG. 5A.

In another illustrated example, as particularly shown in FIGS. 5A-5B, the engagement mechanisms 20, 22, 24, 26 may be secured between the inner layer 30 and the outer layer 32 of the glove 10. The engagement mechanisms 20, 22, 24, 26 may be secured to either the inner layer 30 or the outer layer 32 or a combination thereof. Alternatively, the engagement mechanisms 20, 22, 24, 26 may be held in place by attaching the inner layer 30 to the outer layer 32 around the perimeter of the engagement mechanisms 20, 22, 24, 26.

In this arrangement, there will be no discernable difference to an observer from a traditional riding glove, except for a slight bulge in the outer layer 32 from the engagement mechanisms 20, 22, 24, 26. Furthermore, the engagement mechanisms 20, 22, 24, 26 should have an attractive force sufficient to connect the corresponding engagement mechanisms through the outer layer 32 of the glove 10. In this arrangement, it is preferable for the engagement mechanisms 20, 22, 24, 26 to be magnets, which will allow the engagement mechanisms 20, 24 to releasably connect to their corresponding engagement mechanisms 22, 26 through the outer layer 32 of the glove 10.

Figure 6A:
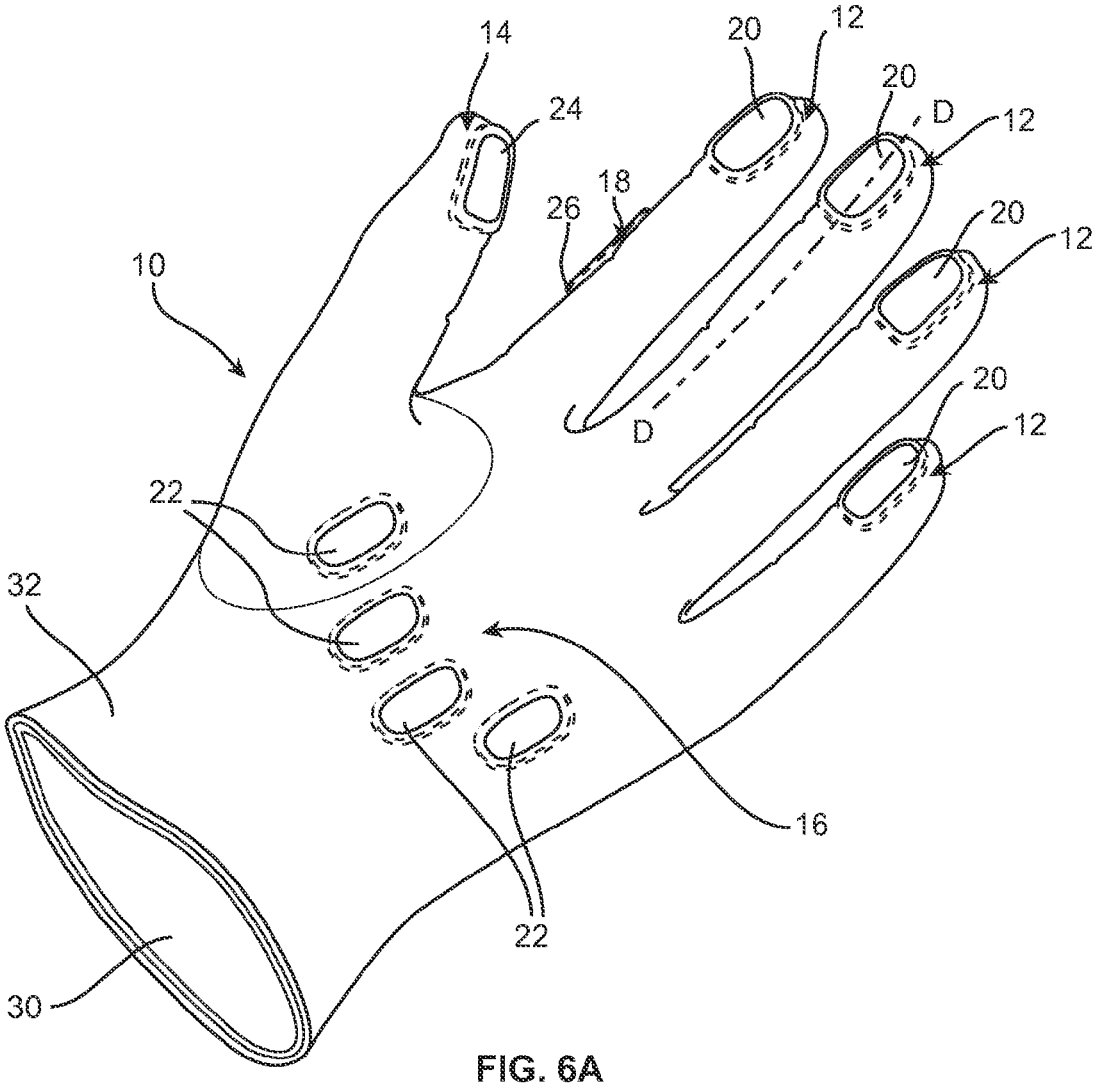
FIG. 6A illustrates a perspective view of a horseback riding training glove in the open position according to another embodiment of the present invention.
Figure 6B:
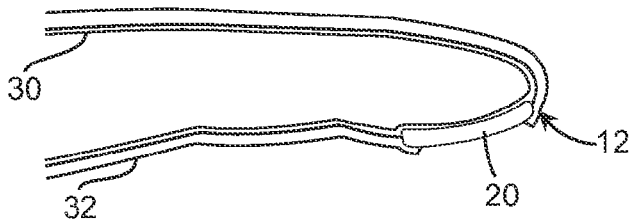
FIG. 6B illustrates a cross section view of a finger along the line F-F in the glove of FIG. 6A.

In another embodiment, as particularly illustrated in FIGS. 6A-6B, the engagement mechanisms 20, 22, 24, 26 are attached to the inner layer 30 of the glove 10 in a similar manner as described in FIGS. 5A-5B. At least a portion of the area covering the engagement mechanisms 20, 22, 24, 26 on the outer layer 32 may be removed so that the engagement mechanisms 20, 24 may directly connect with their corresponding engagement mechanisms 22, 26. This arrangement will also provide a more uniform thickness of the glove 10.

Figure 7A:
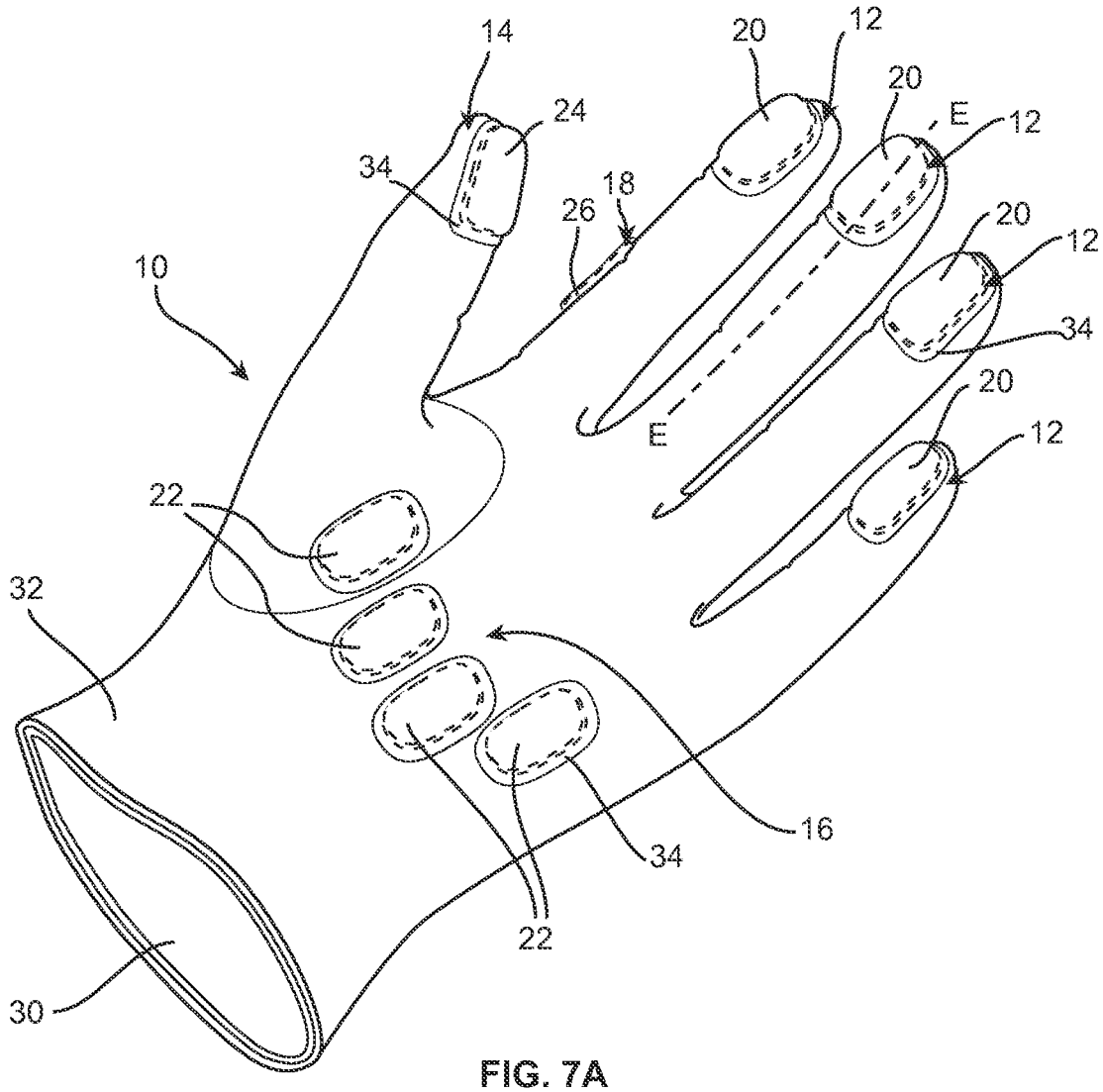
FIG. 7A illustrates a perspective view of a horseback riding training glove in the open position according to another embodiment of the present invention.
Figure 7B:
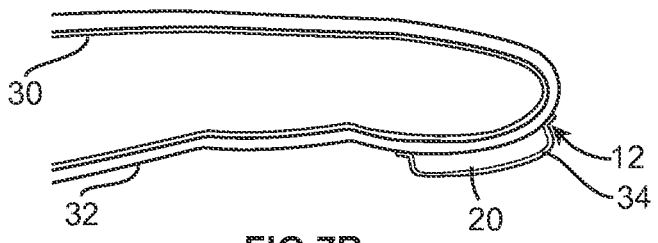
FIG. 7B illustrates a cross section view of a finger along the line G-G in the glove of FIG. 7A.

In another embodiment, as more particularly illustrated in FIGS. 7A-7B, the engagement mechanisms 20, 22, 24, 26 may be positioned on the outer layer 32 of the glove 10, and a cover layer 34 may be attached to the outer layer 32 of the glove 10 around the engagement mechanisms 20, 22, 24, 26, thereby encasing the engagement mechanisms 20, 22, 24, 26 between the outer layer 32 of the glove 10 and the cover layer 34. The cover layer 34 may be constructed with a material similar to the outer layer 32 of the glove 10. For example, the cover layer 34 may be constructed from suede. Alternatively, the cover layer 34 may be constructed out of a different material than the outer layer 32 of the glove 10. For example, the cover layer 34 may be plastic.

The cover layer 34 may be attached to the outer layer 32 of the glove 10 by any means known to one of skill in the art. For example, the cover layer 34 may be attached by sewing the cover layer 34 to the outer layer 32 of the glove 10. Alternatively, the cover layer 36 may be attached to the outer layer 32 of the glove 10 by an adhesive. Furthermore, the cover layer 34 may be attached to the outer layer 32 of the glove 10 by thermal bonding.

Figure 8A:
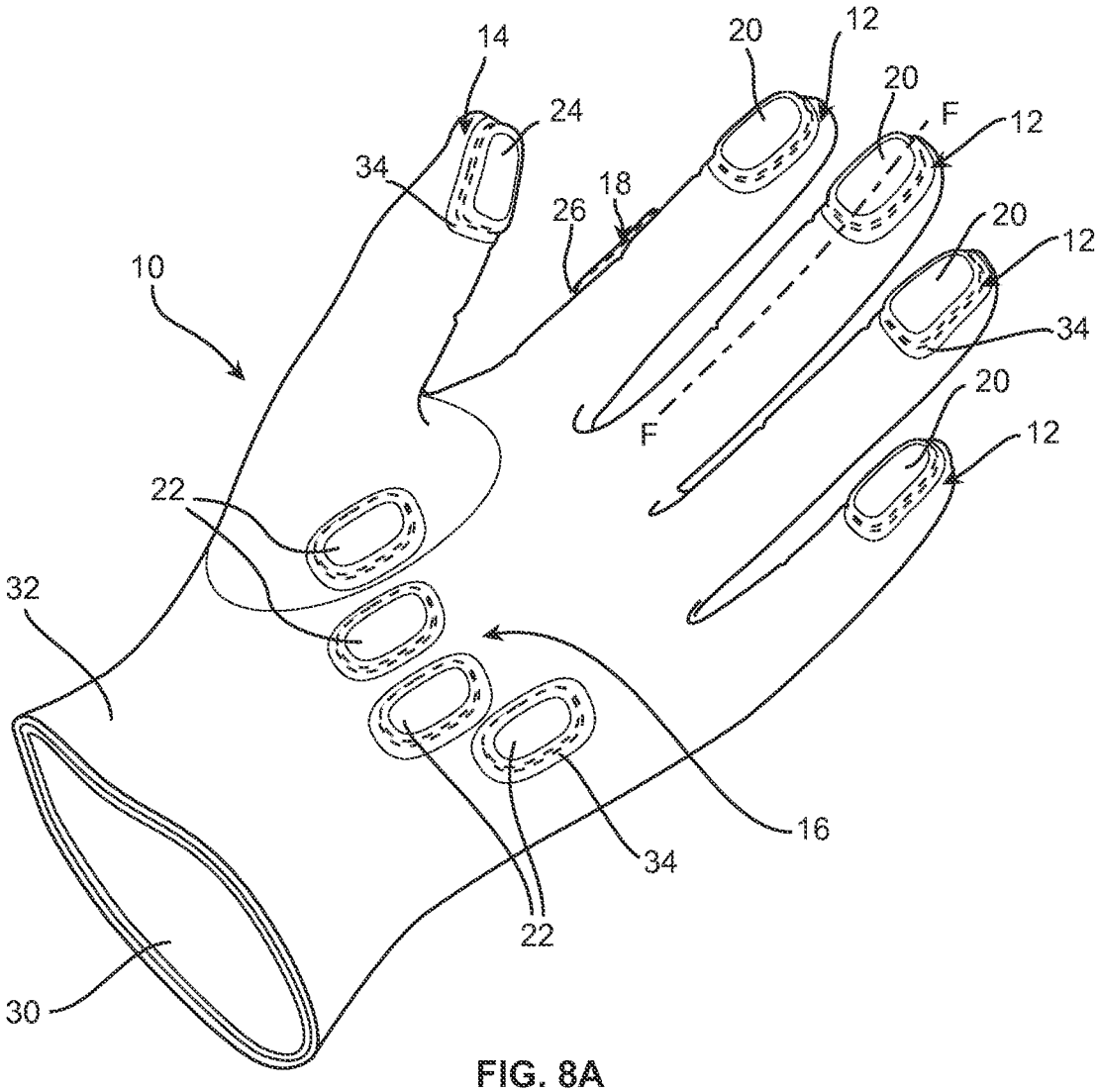
FIG. 8A illustrates a perspective view of a horseback riding training glove in the open position according to another embodiment of the present invention.
Figure 8B:
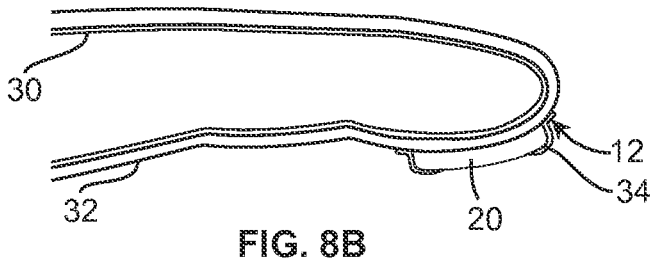
FIG. 8B illustrates a cross section view of a finger along the line H-H in the glove of FIG. 8A.

In another embodiment, as more particularly illustrated in FIG. 8A-8B, the glove illustrated in FIGS. 7A-7B may have at least a portion of the area covering the engagement mechanisms 20, 22, 24, 26 on the cover layer 34 removed so that the engagement mechanisms 20, 24 may directly connect with their corresponding engagement mechanisms 22, 26.

Figure 9A:
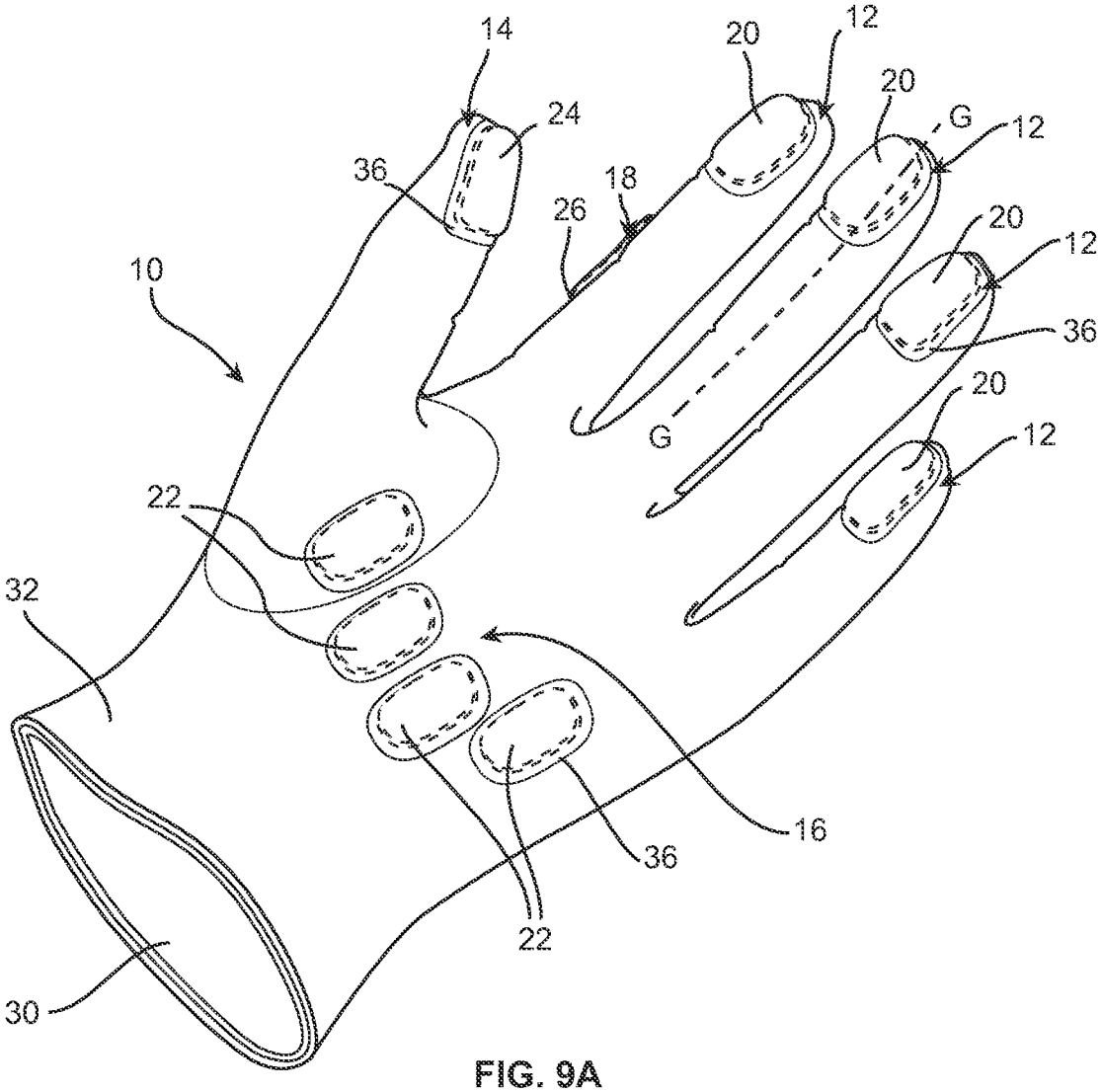
FIG. 9A illustrates a perspective view of a horseback riding training glove in the open position according to another embodiment of the present invention.
Figure 9B:
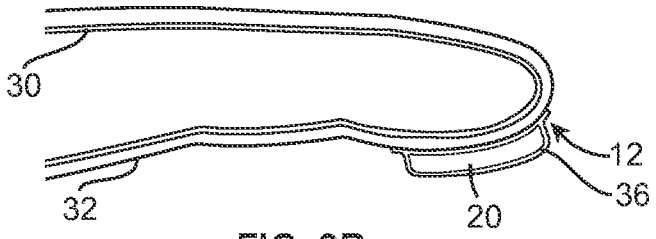
FIG. 9B illustrates a cross section view of a finger along the line J-J in the glove of FIG. 9A.

Referring now to FIGS. 9A-9B, there is shown a horseback riding training glove 10 where the engagement mechanisms 20, 22, 24, 26 may be encased in a pocket 36. The pocket 36 may then be attached to the outer layer 32 of the glove 10. The pocket 36 may be constructed with a material similar to the outer layer 32 of the glove 10. For example, the pocket 36 may be constructed from suede. Alternatively, the pocket 36 may be constructed out of a different material than the outer layer 32 of the glove 10. For example, the pocket 36 may be plastic.

The pocket 36 may be attached to the outer layer 32 of the glove 10 by any means known to one of skill in the art. For example, the pocket 36 may be attached by sewing the pocket 36 to the outer layer 32 of the glove 10. Alternatively, the pocket 36 may be attached to the outer layer 32 of the glove 10 by an adhesive. Furthermore, the pocket 36 may be attached to the outer layer 32 of the glove 10 by thermal bonding.

Figure 10A:
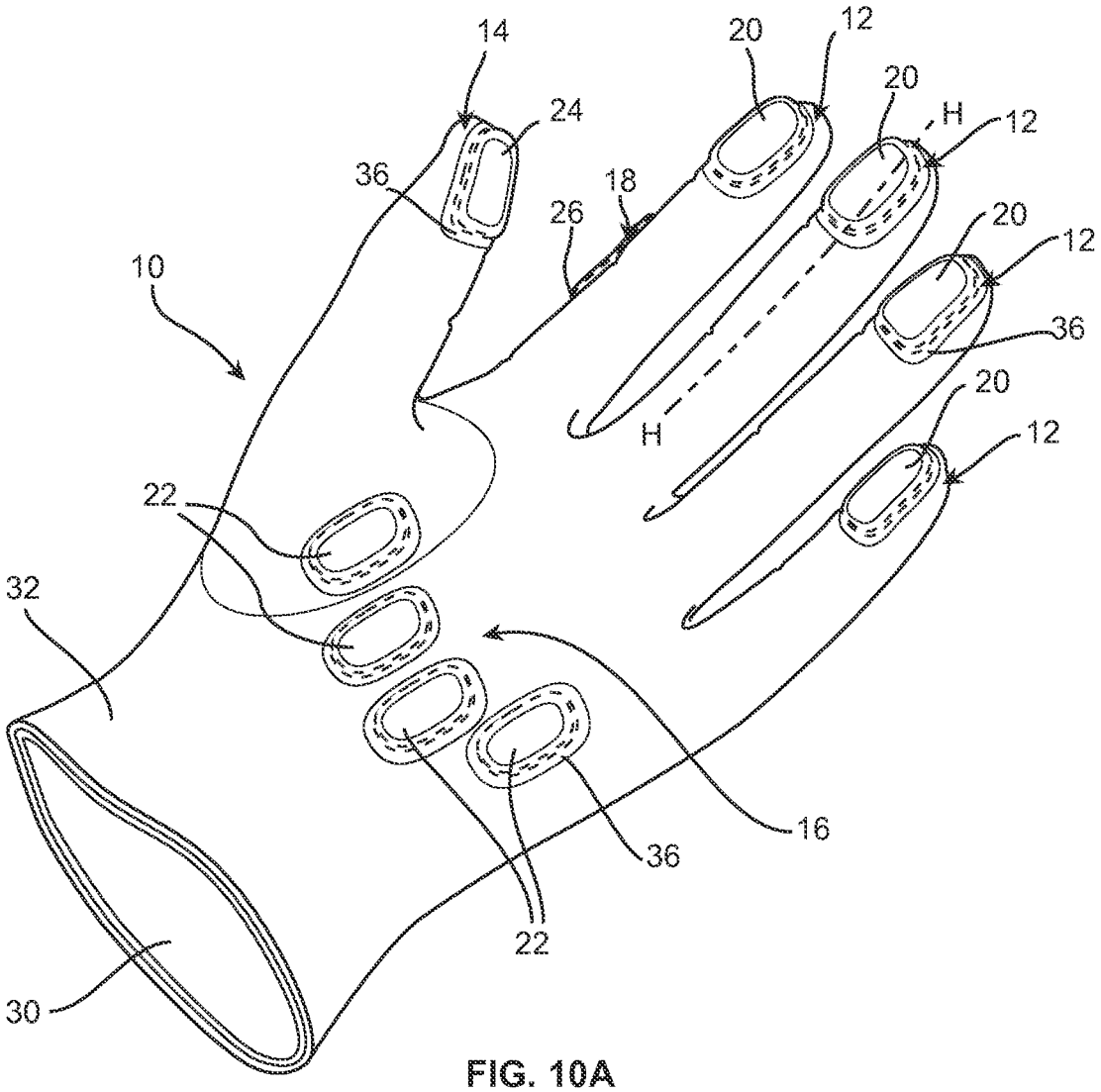
FIG. 10A illustrates a perspective view of a horseback riding training glove in the open position according to another embodiment of the present invention.
Figure 10B:
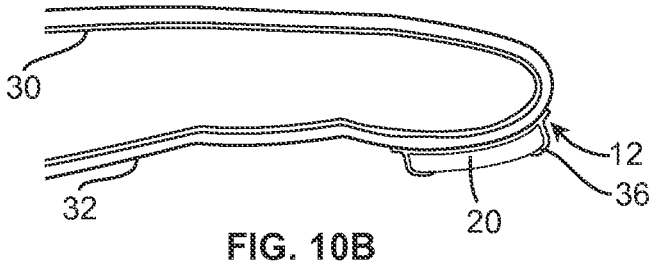
FIG. 10B illustrates a cross section view of a finger along the line K-K in the glove of FIG. 10A.

In another embodiment, as more particularly illustrated in FIG. 10A-10B, the glove illustrated in FIGS. 9A-9B may have at least a portion of the area covering the engagement mechanisms 20, 22, 24, 26 on the pocket 36 removed so that the engagement mechanisms 20, 24 may directly connect with their corresponding engagement mechanisms 22, 26.

Figure 11A:
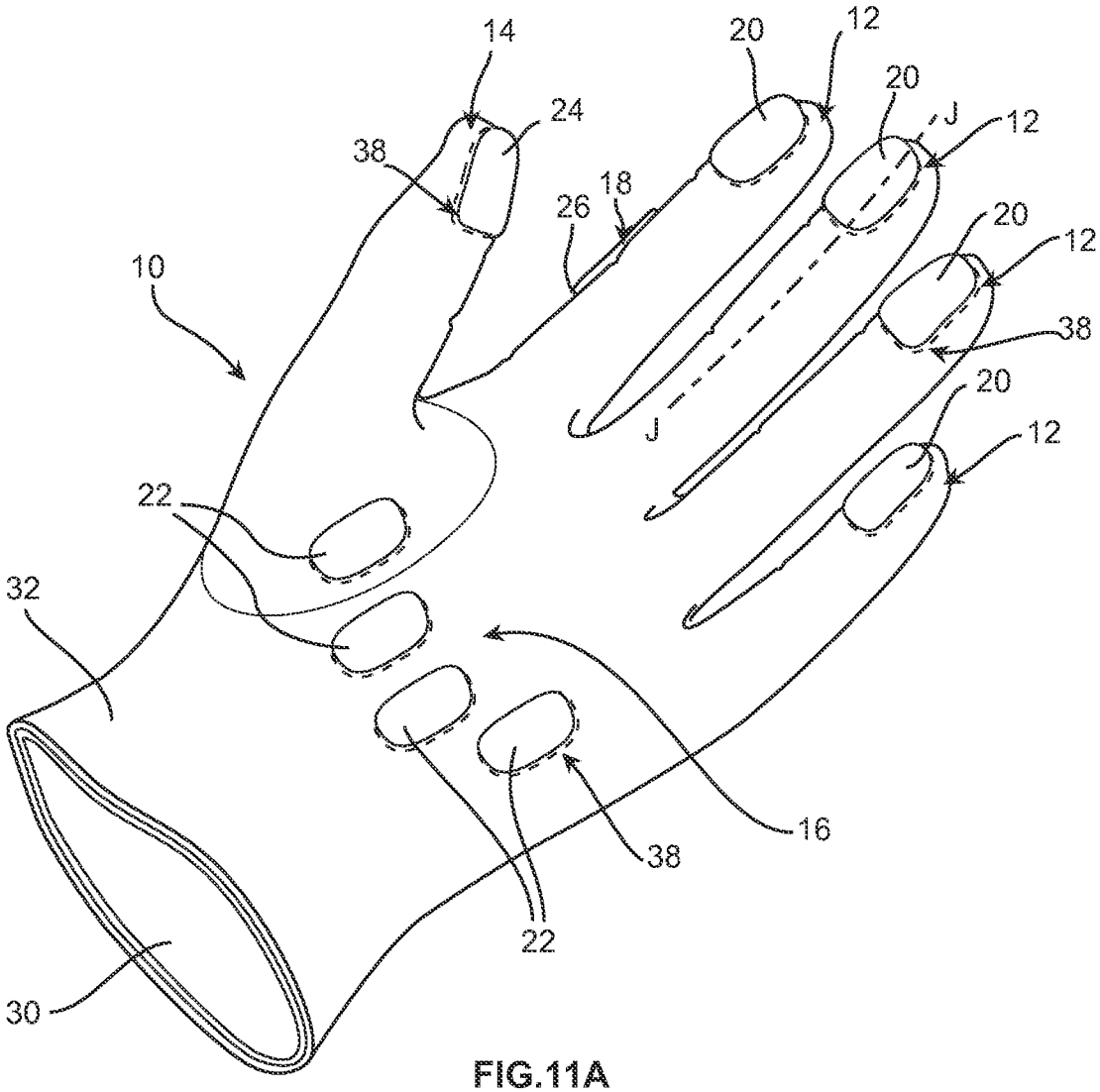
FIG. 11A illustrates a cross section view of a finger section of a horseback riding training glove according to another embodiment of the present invention.
Figure 11B:
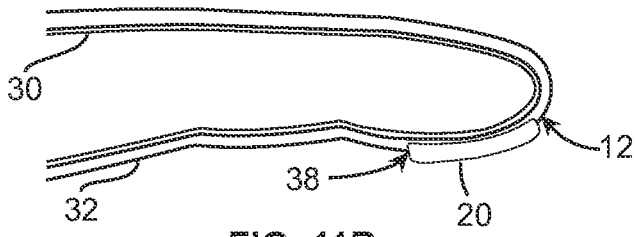
FIG. 11B illustrates a cross section view of a finger section of a horseback riding training glove according to another embodiment of the present invention.

In another embodiment, as particularly illustrated in FIGS. 11A-11B, there is shown a horseback riding training glove 10 where the fingertip section 12, thumbtip section 14, palm section 16, and side index finger section 18 have been impressed, thereby creating indentations 38. As a result, the thicknesses of the glove 10 in the areas of the indentations 38 are less than the thickness of the remainder of the glove 10. The engagement mechanisms 20, 22, 24, 26 may then be secured in the indentations 38 with, for example, adhesive. The indentations 38 can be made by any means known to one of skill in the art. For example, the indentations 38 can be made by debossing. As illustrated, only the outer layer 32 may be debossed. Alternatively, both the inner layer 30 and the outer layer 32 may be debossed. In embodiments where the engagement mechanisms are positioned between the inner layer and the outer layer, only the inner layer may be debossed.

Figure 12A:
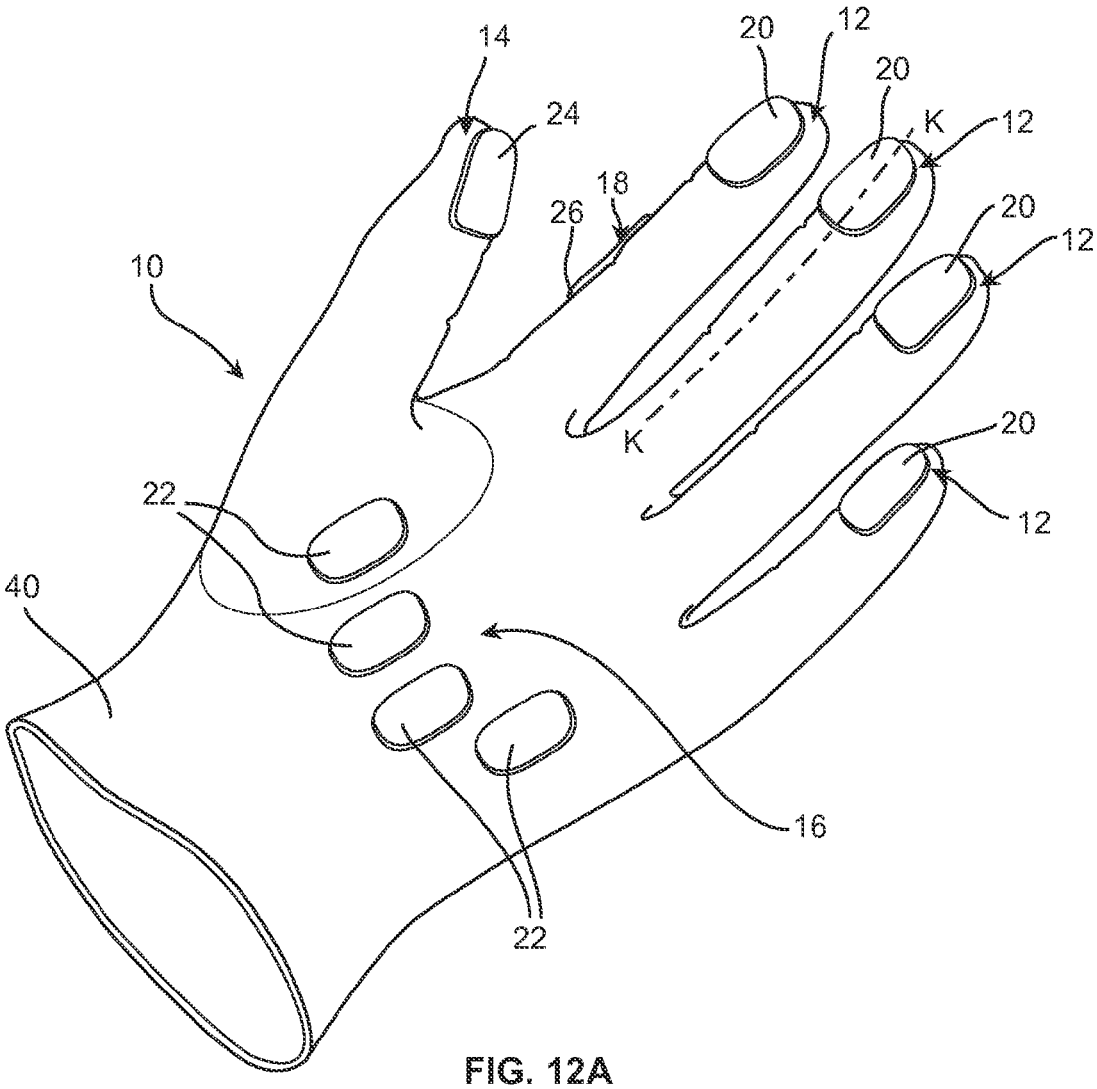
FIG. 12 illustrates a perspective view of a horseback riding training glove gripping the reins according to an embodiment of the present invention.
Figure 12B:
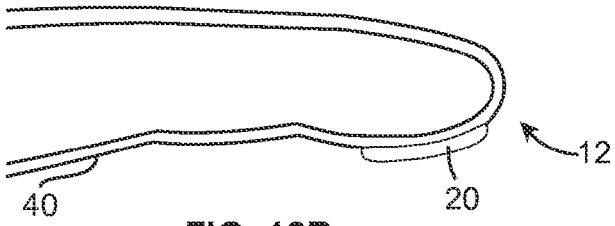

In another embodiment, as particularly illustrated in FIGS. 12A-12B, there is shown a horseback riding training glove 10 where the glove 10 is constructed from a single layer 40. The engagement mechanisms 20, 22, 24, 26 may be attached to the single layer 40 by any means known to one of skill in the art or described herein. For example, as illustrated, the engagement mechanisms 20, 22, 24, 26 may be attached directly to the single layer 40 of the glove 10 in a similar manner as described with respect to FIGS. 1A-1B. Alternatively, the engagement mechanisms 20, 22, 24, 26 may be attached to the single layer 40 as described in any other arrangement disclosed herein.

Figure 13A:
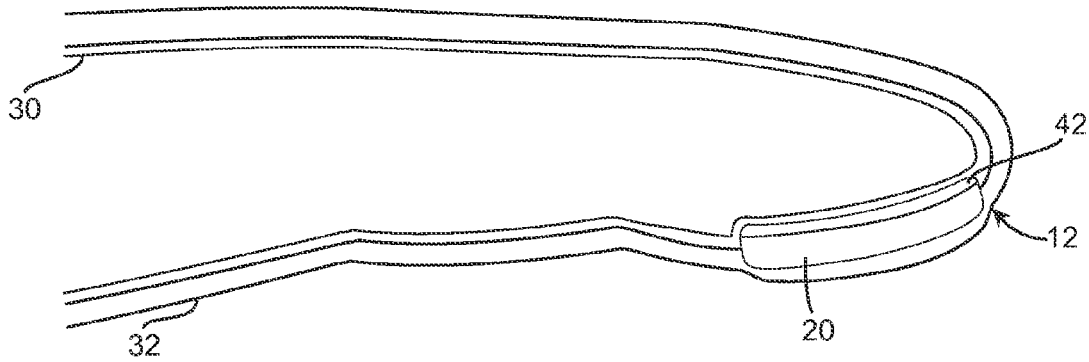
Figure 13B:
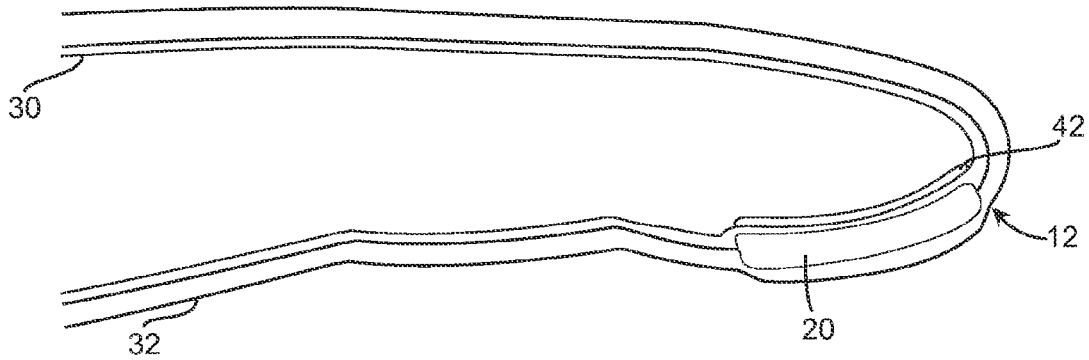

Referring now to FIGS. 13A-13B, there is shown a cross section of a finger of a glove according to FIGS. 5A-5B of the present invention that also includes a padding layer 42 positioned between the engagement mechanisms 20, 22, 24, 26 and the rider's finger. As illustrated in FIG. 13A, the padding layer 42 is positioned between the engagement mechanisms 20, 22, 24, 26 and the outer layer 32. Alternatively, as illustrated in FIG. 13B, the padding layer 42 may be positioned on the inner surface of the inner layer 30, so that the padding layer 42 is in direct contact with a rider's hand. It is to be understood that the padding layer 42 could be positioned adjacent to any layer between the engagement mechanisms 20, 22, 24, 26 and the rider's finger.

The padding layer 42 may help to protect the rider's hands from chaffing against the engagement mechanisms 20, 22, 24, 26. The padding layer 42 may be any material known to one of skill in the art to cushion an impact between the engagement mechanisms 20, 22, 24, 26 and the rider's hands. For example, the padding layer 42 may be a nonwoven material. Alternatively, the padding layer 42 may be a foam material. Furthermore, the padding layer 42 may be a gel material.

It is to be understood that a padding layer 42 may be positioned anywhere between a rider's finger and the engagement mechanisms and may be employed with any embodiment disclosed herein.

Figure 14A:
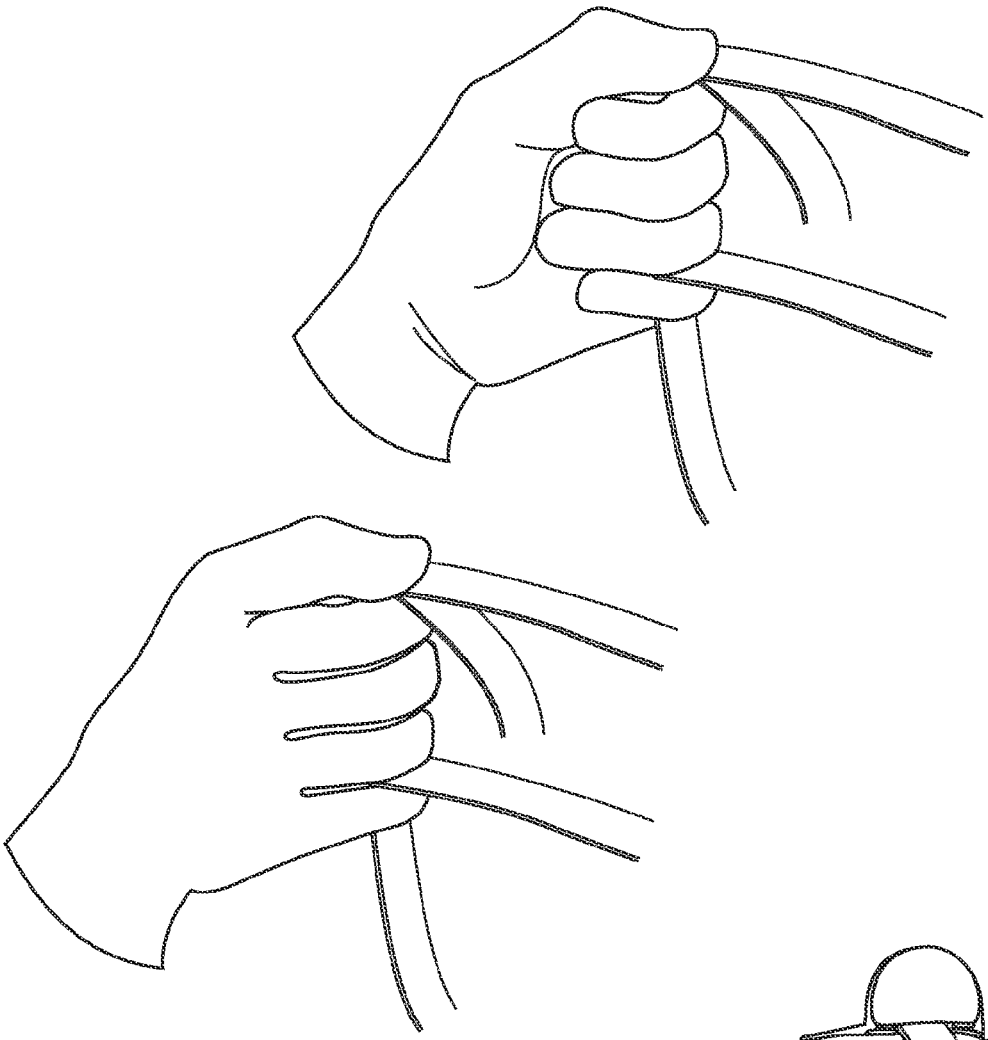
Figure 14B:
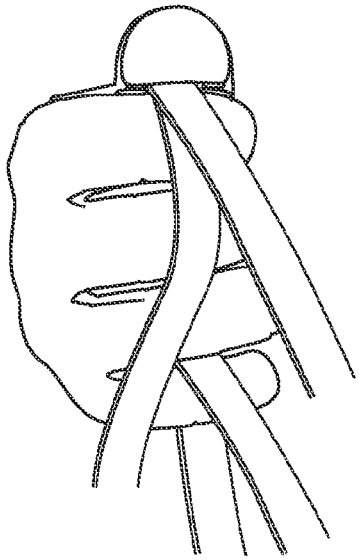

Referring now to FIGS. 14A-14B, there is shown a horseback riding training glove 10 gripping the reins with the engagement mechanisms 20, 22, 24, 26 in the connected position. The engagement mechanisms 20 positioned on the plurality of fingertip sections 12 are releasably connected with the engagement mechanisms 22 positioned on the palm section 16. In a similar fashion, the engagement mechanism 24 positioned on the thumbtip section 14 is releasably connected with the engagement mechanism 26 positioned on the side index finger section 18. In the connected position, the rider's hands are secured about the reins in the proper position, but the rider can disengage the engagement mechanisms 20, 22, 24, 26 by spreading out their fingers.

In yet another embodiment, the engagement mechanisms in any example disclosed herein may also be differentiated from the glove by using a different color for the engagement mechanisms than the glove. Thus, when the rider's hands are in the correct position, and the engagement mechanisms are engaged, the differentiated color of the engagement mechanisms will not be able to be seen. This differentiation may also aid the rider in placing the fingertip sections in the correct position on the palm section and the thumbtip section on the correct position on the side index finger section when engaging the engagement mechanisms. Furthermore, the color differentiation may also provide a quick reference to the rider to ensure that their hands have not moved into an improper position. Moreover, an instructor may be able to quickly see if the rider's hands have moved out of position.

Alternatively, the engagement mechanisms may be the same color as the glove. This arrangement would provide a glove that appears to be a standard glove.

It will be apparent to those skilled in the art that modifications and variations may be made in the systems and methods of the present invention without departing from the spirit or scope of the invention. It is intended that the present invention cover the modifications and variations of this invention provided they come within the scope of the appended claims and their equivalents.

For example, although the present invention has been described with one engagement mechanism in each section, the present invention could be configured to include more than one engagement mechanism per section in any number of configurations or patterns.

Furthermore, although the present invention has been described with a glove having one or two layers, the present invention could be configured to include a glove having more than two layers.

Moreover, although the present invention has been described in terms of a horseback riding training glove, the present invention could be configured to include training gloves for other sports, such as golf, or other activities where the ability of the user to keep their fingers in a specific position would be helpful.

What is claimed is:

1. A glove for training a horseback rider's fingers to hold reins in a proper position, the glove comprising: a plurality of fingertip sections having at least one engagement mechanism positioned on each fingertip section, wherein the plurality of fingertip sections includes an index fingertip section having an engagement mechanism positioned on the index fingertip section; a thumbtip section, having at least one engagement mechanism positioned on the thumbtip section; a side index finger section, having at least one engagement mechanism positioned on the side index finger section adjacent the at least one engagement mechanism positioned on the thumbtip section, wherein the side index finger section is generally disposed on a plane different than the index fingertip section and wherein the at least one engagement mechanism positioned on the thumbtip section and the at least one engagement mechanism positioned on the side index finger section are designed to releasably engage with each other to selectively position the reins between the at least one engagement mechanism positioned on the thumbtip section and the at least one engagement mechanism positioned on the side index finger section; and a palm section, having at least one engagement mechanism positioned on the palm section.

2. The glove of claim 1, wherein the engagement mechanisms positioned on the plurality of fingertip sections are adapted to releasably connect with the at least one engagement mechanism positioned on the palm section.

3. The glove of claim 1, wherein the glove comprises an inner layer and an outer layer adjacent to the inner layer and wherein the engagement mechanisms are magnets.

4. The glove of claim 3 further comprising a cover layer positioned over the engagement mechanisms and wherein the cover layer is attached to the outer layer.

5. The glove of claim 4, wherein at least a portion of the cover layer is removed so that the engagement mechanisms positioned on each fingertip section can directly connect with the at least one engagement mechanism positioned on the palm section and the at least one engagement mechanism positioned on the thumbtip section can directly connect with the at least one engagement mechanism positioned on the side index finger section.

6. The glove of claim 1, wherein the engagement mechanisms are encased within a pocket, and wherein the pocket is attached to the glove.

7. The glove of claim 6, wherein at least a portion of the pocket is removed so that the engagement mechanisms positioned on each fingertip section can directly connect with the at least one engagement mechanism positioned on the palm section and the at least one engagement mechanism positioned on the thumbtip section can directly connect with the at least one engagement mechanism positioned on the side index finger section.

8. The glove of claim 1, wherein the plurality of fingertip sections, the thumbtip section, the side index finger section, and the palm section have been debossed to form an indentation in an inner layer, outer layer, or combination thereof, and wherein the engagement mechanisms are attached to the glove within the indentations.

9. The glove of claim 1 comprising a padding layer positioned between the engagement mechanisms and a rider's hand.

10. The glove of claim 1, wherein the side index finger section comprises two engagement mechanisms spaced apart from about 0.25 inches to about 1.5 inches.

11. The glove of claim 1, wherein the thumbtip section comprises two engagement mechanisms spaced apart from about 0.25 inches to about 1.5 inches.

12. A glove for training a horseback rider's fingers to hold reins in a proper position, the glove comprising: an inner layer; an outer layer, a plurality of fingertip sections having at least one engagement mechanism positioned on each fingertip section; a thumbtip section, having at least one engagement mechanism positioned on the thumbtip section; a side index finger section, having at least one engagement mechanism positioned on the side index finger section and adjacent the at least one engagement mechanism positioned on the thumbtip section, wherein the side index finger section is generally disposed on a plane different than an index fingertip section, wherein the at least one engagement mechanism positioned on the thumbtip section and the at least one engagement mechanism positioned on the side index finger section are designed to releasably engage with each other to selectively position the reins between the at least one engagement mechanism positioned on the thumbtip section and the at least one engagement mechanism positioned on the side index finger section; a palm section, having at least one engagement mechanism positioned on the palm section; and wherein the engagement mechanisms are positioned between the inner and the outer layer.

13. The glove of claim 12, wherein the engagement mechanisms have a sufficient release force that allows the engagement mechanisms to stay connected when a rider is performing maneuvers, and also allows the rider to disconnect the engagement mechanisms by the rider spreading out their fingers.

14. The glove of claim 12, wherein at least a portion of the outer layer is removed so that the engagement mechanisms positioned on each fingertip section can directly connect with the at least one engagement mechanism positioned on the palm section and the at least one engagement mechanism positioned on the thumbtip section can directly connect with the at least one engagement mechanism positioned on the side index finger section.

15. The glove of claim 12, wherein the plurality of fingertip sections, the thumbtip section, the side index finger section, and the palm section have been debossed to form an indentation in the inner layer, outer layer, or a combination thereof, and wherein the engagement mechanisms are attached to the glove within the indentations.

16. The glove of claim 12, wherein the engagement mechanisms are magnets.

17. The glove of claim 12 further comprising a padding layer positioned between the engagement mechanisms and a rider's hand.

18. The glove of claim 12, wherein the side index finger section comprises two engagement mechanisms spaced apart from about 0.25 inches to about 1.5 inches.

19. The glove of claim 12, wherein the thumbtip section comprises two engagement mechanisms spaced apart from about 0.25 inches to about 1.5 inches.

20. A glove for training a horseback rider's fingers to hold reins in a proper position, the glove comprising: a thumbtip section, having at least one engagement mechanism positioned on the thumbtip section; a side index finger section, having at least one engagement mechanism positioned on the side index finger section adjacent the at least one engagement mechanism positioned on the thumbtip section, wherein the side index finger section is generally disposed on a plane different than an index fingertip section and wherein the at least one engagement mechanism positioned on the thumbtip section and the at least one engagement mechanism positioned on the side index finger section are designed to releasably engage with each other to selectively position the reins between the at least one engagement mechanism positioned on the thumbtip section and the at least one engagement mechanism positioned on the side index finger section.

21. The glove of claim 1, wherein the side index finger section is generally disposed on a plane perpendicular to the index fingertip section.

22. The glove of claim 1, wherein the side index finger section is generally disposed on a plane perpendicular to the palm section.

23. The glove of claim 20, wherein the side index finger section is generally disposed on a plane perpendicular to the index fingertip section.

* * * * *